US008881703B2

(12) United States Patent
Moeller et al.

(10) Patent No.: US 8,881,703 B2
(45) Date of Patent: Nov. 11, 2014

(54) APPARATUS FOR ACTUATING AT LEAST ONE OUTLET VALVE OF A VALVE-CONTROLLED INTERNAL COMBUSTION ENGINE

(71) Applicant: MAN Truck & Bus AG, Munich (DE)

(72) Inventors: Heribert Moeller, Sachsen (DE); Rainer Kalass, Rohr (DE)

(73) Assignee: MAN Truck & Bus AG, Munich (DE)

( * ) Notice: Subject to any disclaimer, the term of this patent is extended or adjusted under 35 U.S.C. 154(b) by 0 days.

(21) Appl. No.: 14/059,936

(22) Filed: Oct. 22, 2013

(65) Prior Publication Data

US 2014/0109852 A1 Apr. 24, 2014

(30) Foreign Application Priority Data

Oct. 22, 2012 (DE) ..... 10 2012 020 594

(51) Int. Cl.
*F01L 1/18* (2006.01)
*F01L 1/24* (2006.01)
*F01L 13/06* (2006.01)

(52) U.S. Cl.
CPC ... *F01L 1/18* (2013.01); *F01L 1/24* (2013.01); *F01L 13/06* (2013.01)
USPC ..... 123/90.39; 123/90.11; 123/90.44; 123/90.45

(58) Field of Classification Search
USPC ..... 123/90.11, 90.39, 90.44, 90.45
See application file for complete search history.

(56) References Cited

U.S. PATENT DOCUMENTS 7,905,208 B2 * 3/2011 Ruggiero et al. ..... 123/90.22
2010/0319657 A1 12/2010 Dodi

* cited by examiner

*Primary Examiner* — Ching Chang
(74) *Attorney, Agent, or Firm* — Lucas & Mercanti, LLP

(57) ABSTRACT

An apparatus for actuating at least one outlet valve of a valve-controlled internal combustion engine for motor vehicles, includes an actuating element which is driven by a camshaft. A first piston/cylinder unit, preferably a hydraulically loaded piston/cylinder unit, is provided between a cam of the camshaft and at least one outlet valve. The piston/cylinder unit allows at least one outlet valve to be held in a non-closed intermediate position during an engine braking mode with exhaust-gas backpressure. A second piston/cylinder unit is provided which is configured as a valve-play compensation element, preferably as a hydraulic valve-play compensation element (HVC). At least one valve train-side device is provided between the cam and the at least one outlet valve, which valve train-side device exerts a force which is directed counter to the adjusting action of the HVC but is lower than the latter.

18 Claims, 6 Drawing Sheets

APPARATUS FOR ACTUATING AT LEAST ONE OUTLET VALVE OF A VALVE-CONTROLLED INTERNAL COMBUSTION ENGINE

CROSS-REFERENCE TO RELATED APPLICATIONS

This application claims the priority of DE 10 2012 020 594.5 filed Oct. 22, 2012, which is incorporated by reference herein.

BACKGROUND OF THE INVENTION

The present invention relates to an apparatus for actuating at least one outlet valve of a valve-controlled internal combustion engine for motor vehicles.

It is known, for example, from US 2010/319657 A1 to increase the braking action of an internal combustion engine in the overrun mode by superimposing a decompression action on the exhaust-gas backpressure by means of a pressure flap in the exhaust-gas section (EVB or exhaust valve brake), in which at least one outlet valve per cylinder of the internal combustion engine is held open in an intermediate position in the braking mode. This takes place in the valve train of the internal combustion engine by means of a hydraulically loaded piston/cylinder unit in the force flow between the driving cam of the camshaft and the actuating element which loads the outlet valve, or a rocker arm. Furthermore, a second piston/cylinder unit is arranged in the actuating element, which second piston/cylinder unit is designed as a hydraulic valve-play compensation element (HVC) which is known per se.

BRIEF SUMMARY OF THE INVENTION

It is an object of the invention to develop the apparatus for actuating at least one outlet valve of a valve-controlled internal combustion engine for motor vehicles by way of structurally simple means in such a way that a functionally reliable and destruction-free valve train can be achieved both in the regular mode and in the engine braking mode or EVB.

According to the invention, it is proposed that at least one means is provided between the driving cam of the valve train and the at least one outlet valve, which means exerts a force which is directed counter to the adjusting action of the HVC but is lower with regard to the latter. It has been found that, in the case of the valve train according to the generic type with two integrated, hydraulically acting piston/cylinder units, complex and indifferent movement sequences can occur, in particular, in the EVB mode as a result of the superimposition of dynamic movements, which movement sequences do not ensure the desired freedom from play in the valve train and, resulting from this, can impair the EVB function. The above-mentioned freedom from play means that a defined play is ensured within defined limits in the valve train, which play can also be, for example, zero or approximately zero and can therefore be an ideal freedom from play. As a result of the proposed, relatively simple measure, this impairment can be eliminated surprisingly, the mass moment of inertia which is increased on the actuating element bringing about a positive influence on the EVB function in the dynamic movement sequence. In the regular mode of the internal combustion engine, the oppositely directed, lower force cannot have a disadvantageous effect on the function of the HVC.

A valve train-side means or device is to be understood, in particular, to be a means or device which has a direct or indirect influence on the movement of the valve train and/or is operatively connected to the valve train at least temporarily.

A further positive effect of a means which is directed counter to or counteracts the adjusting effect of the HVC is that the entire compression path in the fired mode is reduced in this way in the case of a compression of the HVC or the HVC means. Movement is reduced by way of said reduced compression path, as a result of which in turn frictional losses are reduced.

The lower force, directed counter to the adjusting action of the HVC, of the at least one means is to be understood as a force at a location, for example at the location of the means, and follows, in particular, from a force comparison of the force of the at least one means with the force, resulting possibly as a consequence of lever actions, of the HVC at the location of the at least one means.

The means which exerts the lower force which is directed counter to the adjusting action of the HVC can particularly preferably be at least one magnet, for example a permanent magnet or an electromagnet, and/or at least one spring element, for example a leg spring, and/or at least one elastomeric element, for example pull band, which can be of simple configuration in terms of production technology and can be arranged favourably in terms of assembly technology. The means which exerts the lower force which is directed counter to the adjusting action of the HVC can be assigned, for example, to an actuating element and/or a valve crosshead between the actuating element and outlet valve/valves and/or a connecting cup between the actuating element and the valve crosshead and/or a stationary brace of the valve train, which brace is assigned to a valve crosshead, in particular can be arranged there in such a way that it interacts with, or acts on, an adjacent component in the required manner.

A means or device of this type can therefore be both a permanently acting prestressing element and a temporarily acting prestressing element. For example, it could be provided in conjunction with a temporarily acting means that said means acts in a temporally limited manner, for example depending on the rotational speed. This could be brought about, for example, by means of an electromagnet which is then actuated at defined times.

In conjunction with the embodiment of the means by way of a magnet, it can be provided, furthermore, that not only the attraction forces of a magnet are utilized here, but rather as an alternative or optionally also in addition the repelling force of a plurality of magnets is utilized, which depends on the concrete local arrangement of the magnets in the respective individual case. For example, if the repelling force of a plurality of, in particular two, magnets is used, they can be arranged at the contact point between the actuating element and the valve crosshead, as a result of which the magnets counteract not only the second piston/cylinder unit, but rather also the weight or the mass moment of inertia of the actuating element which is preferably configured as a rocker arm. It goes without saying that magnets which, attract one another can also be used, which magnets are assigned to one another in each case on the adjacent and/or interacting components.

A magnet of this type can in principle be produced from every suitable material or substance. It is particularly advantageous to produce the magnet from the material neodymium. A neodymium magnet of this type has the advantage that its magnetic properties can be activated only after production and/or assembly, with the result that, for example, an accumulation of chips on the magnet during production and/or assembly can advantageously be avoided.

In addition to a means which exerts the lower, oppositely directed force and is preferably configured by way of a magnet, it can be provided to provide a sacrificial magnet in the close range thereof, on which sacrificial magnet, in particular, metallic contaminants, such as abraded metal, etc., can accumulate, with the result that said contaminants are not collected on the means itself or in the close range thereof. However, as an alternative or in addition, this can also be realized or implemented by way of a corresponding surface geometry, for example a container-like collecting and receiving bead, etc.

The actuating element can be a two-arm rocker lever, on the lever of which, which acts on the outlet valve, the first piston/cylinder unit is arranged, and on the lever of which, which interacts with the cam of the camshaft, the HVC is arranged indirectly or directly. Here, the rocker arm can be configured in one piece or in multiple pieces, in particular in two pieces, having a cam lever which runs onto the cam of the camshaft and an actuating lever which acts on the outlet valve, the HVC with the means which exerts an oppositely directed force preferably being connected in between the cam lever and the actuating lever. This therefore brings about deliberately limited coupling of the two bulky components in the EVB mode without impairing the play compensation function of the HVC.

Furthermore, a plurality of, in particular two, outlet valves can be provided in the valve train per cylinder of the internal combustion engine, which outlet valves are actuated jointly via a valve crosshead by the actuating element or rocker arm, the first piston/cylinder unit being arranged in the valve crosshead and acting, for example, on only one outlet valve in order to achieve the EVB function.

Furthermore, the first piston/cylinder unit and the HVC can be supplied with compressed oil jointly by a pressure-circulating lubricating-oil system of the internal combustion engine, a non-return valve being arranged in the feed line to the first piston/cylinder unit, and, furthermore, the pressure space of the first piston/cylinder unit having a discharge line which is controlled via a stationary brace in the closed state of the at least one outlet valve, and the piston/cylinder unit and the valve spring of the outlet valve being co-ordinated in such a way that the outlet valve remains open in a defined manner in the engine braking mode with a correspondingly closed exhaust-gas flap in the exhaust-gas system of the internal combustion engine. Here, the at least one means which exerts the oppositely directed force ensures effectively that the valve crosshead and the brace interact in a targeted manner in the dynamic movement sequence in the EVB function in such a way that the piston/cylinder unit or its pressure space is supplied reliably with lubricating oil.

Accordingly, in an additional or alternative refinement of the invention, the at least one means which exerts an oppositely directed force on the HVC can also be arranged on the valve crosshead and/or on the actuating lever of the rocker lever and, therefore acting between the valve crosshead and the actuating element, and/or can be inserted on the valve crosshead and/or on the stationary brace and therefore acting between the valve crosshead and the brace. The two variants per se, and also a combination of both variants, serve to maintain the described EVB function reliably.

According to a further particularly preferred embodiment, the brace and/or the valve crosshead can be provided with a piston/cylinder unit (third piston/cylinder unit). Said third piston/cylinder unit serves to "adjust" the contact connection between the brace and the valve crosshead, in particular the closing contact between the brace and the valve crosshead, in reaction to the compensation movement as intended of the HVC element for the wear compensation of the valve-train wear. For example, the valve head can "dig into" the valve seat over the service life of the engine, as a result of which the closed position (rest position) of the valve and accordingly of its valve stem is elevated. If the brace and/or the valve crosshead had no compensation possibility for this, disadvantageous stresses (compressive forces) would occur between the valve crosshead and the brace and/or between the brace, the valve crosshead and the valve stem. As a result of the provision of a piston/cylinder unit in the brace and/or in the valve crosshead, "rest position changes" can generally be compensated for. In addition, as a result, as an alternative or additionally, functionally reliable closure of a valve crosshead-side discharge channel by the brace can be ensured, in particular while passing through the base circle of the cam.

BRIEF DESCRIPTION OF THE DRAWINGS

A plurality of exemplary embodiments of the invention are explained in greater detail in the following text with further details. In the diagrammatic drawing.

DETAILED DESCRIPTION OF THE PREFERRED EMBODIMENTS

Figure 1:
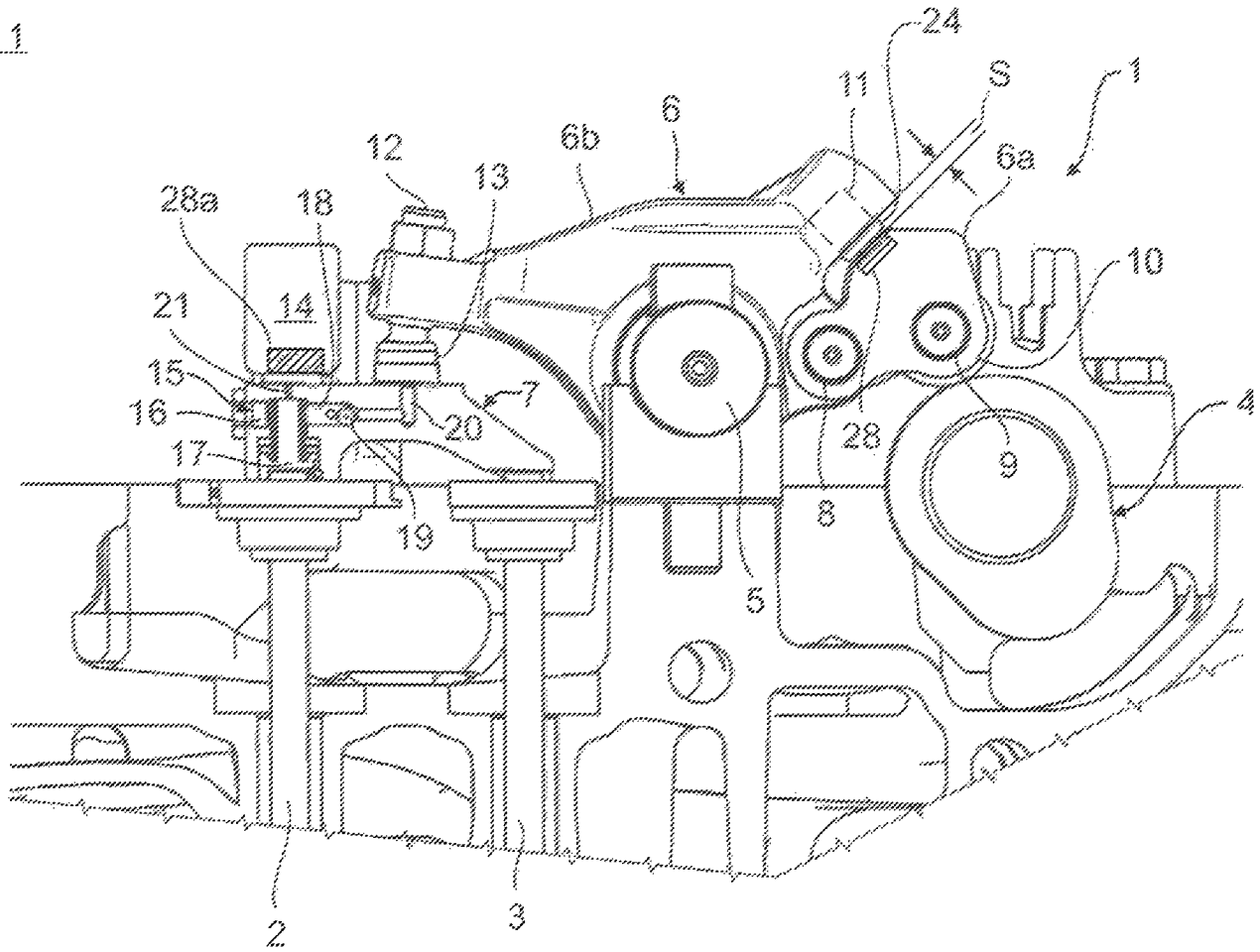
FIG. 1 shows a partial cross section through a cylinder head of a valve-controlled reciprocating-piston internal combustion engine for motor vehicles having two outlet valves per cylinder which are driven via a two-part rocker arm and a valve crosshead by a cam of the camshaft of the internal combustion engine, a piston/cylinder unit for providing an EVB function and a piston/cylinder unit as HVC element being integrated into the valve train.

Only in so far as it is required in order to understand the present invention, FIG. 1 shows a cylinder head 1 of a valve-controlled reciprocating-piston internal combustion engine, in particular of a four-stroke reciprocating-piston internal combustion engine (diesel engine), in which, in addition to the inlet valves which cannot be seen, two outlet valves 2, 3 (only the valve stems can be seen) are guided displaceably. The valve springs which hold the valves 2, 3 closed in a known manner are not shown here.

The valve train which acts on the outlet valves 2, 3 is composed of a driving cam 4, of a camshaft of the internal combustion engine, a rocker arm 6 which is mounted pivotably on a fixed rocker-arm axis 5, and a valve crosshead 7 which bridges the two outlet valves 2.

Here, the functionally two-arm rocker arm 6 is of two-part configuration by way of example, having a cam lever 6*a* and an actuating lever 6*b* which acts on the valve crosshead 7, which levers 6*a*, 6*b* project to both sides from the mounting on the rocker-arm axis 5.

The cam lever 6*a* of the rocker arm 6 is mounted pivotably on the actuating lever 6*b* by means of a separate pivot axis 8 and carries a roller 10 which is mounted rotatably on an axis 9 and runs on the cam 4 in order to drive the rocker arm 6.

Lying outside the pivot axis 3, a hydraulic valve-play compensation element 11 is arranged between the cam lever 6*a* and the actuating lever 6*b*, which valve-play compensation element 11 will be explained in further detail in the following text in conjunction with FIG. 2.

The actuating lever 6*b* of the rocker arm 6 loads the valve crosshead 7 via a setting screw 12 (with lock nut) and via a connecting cup 13 which is mounted spherically thereon, at a location which is positioned between the two outlet valves 2, 3.

Furthermore, a stationary brace 14 is provided above the valve crosshead 7, the function of which brace 14 will be explained later.

A piston/cylinder unit 15 is arranged within the valve crosshead 7, having a piston 17 which is guided displaceably to a limited extent in one pressure space 16 and acts on the one outlet valve 2. The pressure space 16 is connected via a feed channel 18 to an integrated non-return valve element, for example a ball check valve 19, and via feed channels (not shown in further detail) which are denoted generally by 20 in the connecting cup 13, the setting screw 12, in the rocker arm 6 and finally via the rocker-arm axis 5 to the pressure-circulating lubricating-oil system of the internal combustion engine. It goes without saying that further channels 20 for lubricating the moving parts of the valve train are also provided in the rocker arm 6 (cf. also FIG. 2).

In addition, a discharge channel 21 of defined cross section is provided in the valve crosshead 7, which discharge channel 21 opens into the pressure space 16 of the piston/cylinder unit 15 and is controlled via the stationary brace 14, as will be described in the following text.

Figure 2:
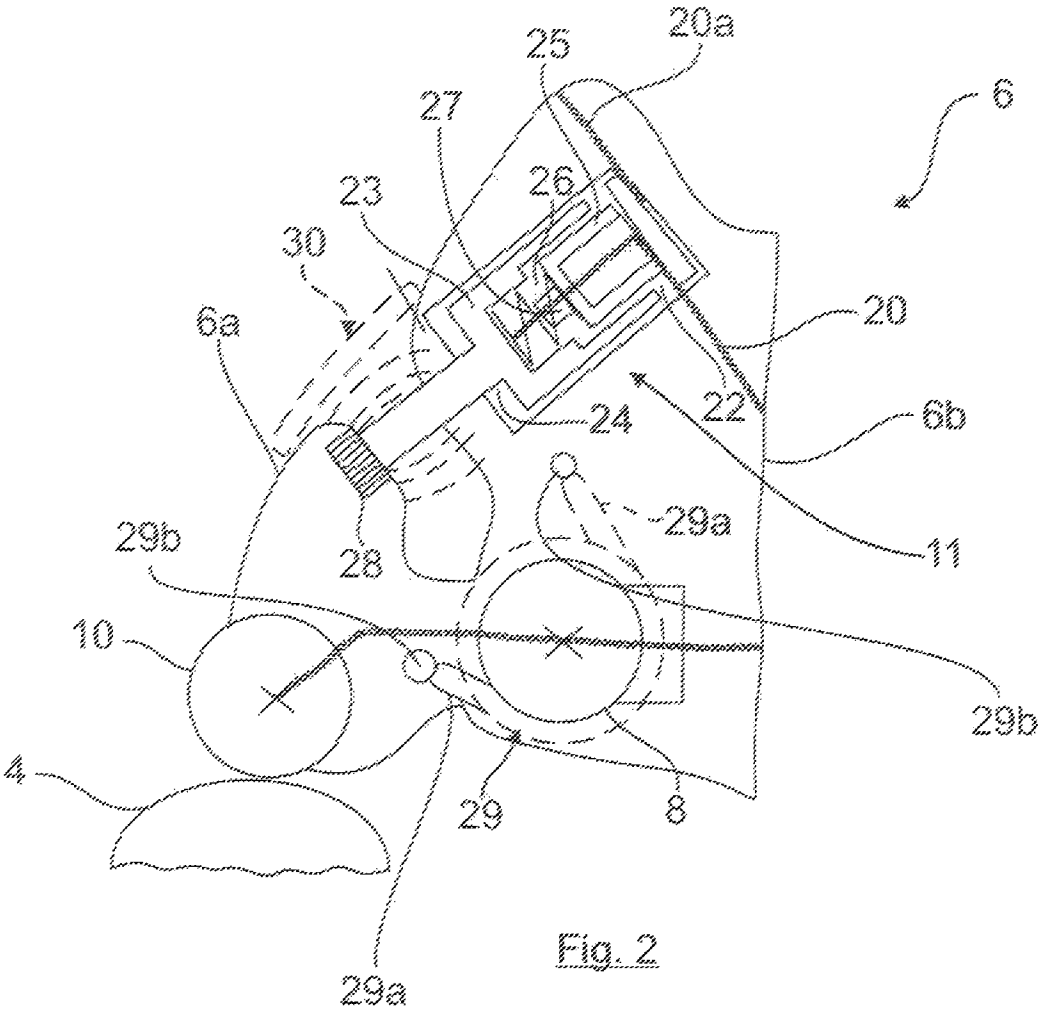
FIG. 2 shows a partial illustration of the two-part rocker arm according to FIG. 1 with the integrated HVC and with alternative means for exerting force which is directed counter to the adjusting action of the HVC.

In an enlarged illustration and diagrammatically, FIG. 2 shows a section of the rocker arm 6 with the cam lever 6*a* and partially the actuating lever 6*b*, into which the HVC 11 which is likewise configured as a piston/cylinder unit is integrated.

To this end, a pressure space 22 which is connected to a feed channel 20 is configured in the actuating lever 6*b*, in which pressure space 22 a first piston 23 is guided displaceably which acts on the cam lever 6*a* by means of a tappet 24.

A second piston 25 is guided displaceably in the piston 23, which second piston 25 delimits a second pressure space 26, in which a non-return valve element, in particular a ball check valve 27, is arranged. Furthermore, a ventilating bore 20*a* is provided.

In a known way, valve play which occurs, for example, as a result of wear in the transmission chain between the cam 4 and the outlet valves 2, 3 and/or the valve crosshead 7 can be eliminated by means of the HVC 11, the tappet 24 extending or retracting correspondingly and changing the spacing s (FIG. 1) between the cam lever 6*a* and the actuating lever 6*b* of the rocker arm 6 correspondingly.

In the regular mode of the internal combustion engine without engine braking, the two outlet valves 2, 3 are opened via the rocker arm 6 and the valve crosshead 7 when passing the cam and are closed again when the cam base circle is reached. Oil can escape from the pressure space 16 via the discharge opening 21 which is free when passing the cam, which oil, however, is replaced again via the feed channels 20 and the non-return valve 19 when passing the base circle.

This dynamic equilibrium changes in the case of engine braking, in which an exhaust-gas flap in the exhaust-gas section of the internal combustion engine is closed and a considerable exhaust-gas backpressure or exhaust-gas pressure acts on that side of the outlet valves which faces away from the combustion chamber, which exhaust-gas backpressure or exhaust-gas pressure holds the outlet valve 2 open in an intermediate position in the case of corresponding coordination of the valve spring of the outlet valve and the design of the piston/cylinder unit 15. It is to be ensured here that the control effect between the valve crosshead 7 (discharge channel 21) and the brace 14 is not disrupted by excessively large valve play which possibly occurs.

To this end, at least one means which exerts a force which is directed counter to the adjusting action of the HVC in the valve train is provided between the cam 4 and the cutlet valves.

According to FIGS. 1 and 2, said means is formed by at least one permanent magnet 28 (shown using hatched lines) which is inserted into the cam lever 6*a* and exerts a magnetic force (attractive force) on the adjacent section of the actuating lever 6*b* and/or the piston 23 or tappet 24. This force has to be lower than the adjusting moment which is exerted by the HVC 11, in order not to impair the regular, fired mode of the internal combustion engine and/or the regular valve-play adjustment.

This permanent magnet 28 or possibly a further permanent magnet 28*a* (FIG. 1) could also be provided in the brace 14, the attractive force of which permanent magnet 28 or further permanent magnet 28*a* is directed at the valve crosshead 7, in order thus to counteract the valve crosshead 7 rising up from the brace 14 when passing the base circle of the cam lever 6*a* in the case of engine braking.

Instead of or possibly also in addition to the arrangement in the brace 14, the permanent magnet 28*a* could also be provided in the connecting cup 13 or, in a reverse way in kinematic terms, in the valve crosshead 7.

FIG. 2 shows further alternative means for exerting the force which is directed counter to the adjusting action of the HVC 11, which alternative means can possibly also be used in a combined manner.

For instance, a leg spring 29 with two spring arms 29*a* which project radially can be arranged around the pivot axis 8 between the cam lever 6*a* and the actuating lever 6*b*, the spring arms 29*a* engaging with ends 29*b* which project at right angles into recesses or holes (without reference numerals) of the levers 6*a*, 6*b* and exerting a slight prestress on the levers 6*a*, 6*b* counter to the adjusting direction of the HVC.

In a further additional or alternative refinement, a spring-elastic and/or elastomeric element, a pull band 30 here by way of example, can be provided between the cam lever 6*a* and the actuating lever 6*b*, which element prestresses the two levers 6*a*, 6*b* with respect to one another in a defined manner. For example, the pull band could be buttoned or fastened in another way to corresponding receptacles at free end sides of the cam lever 6*a* and the actuating lever 6*b*.

Figure 3:
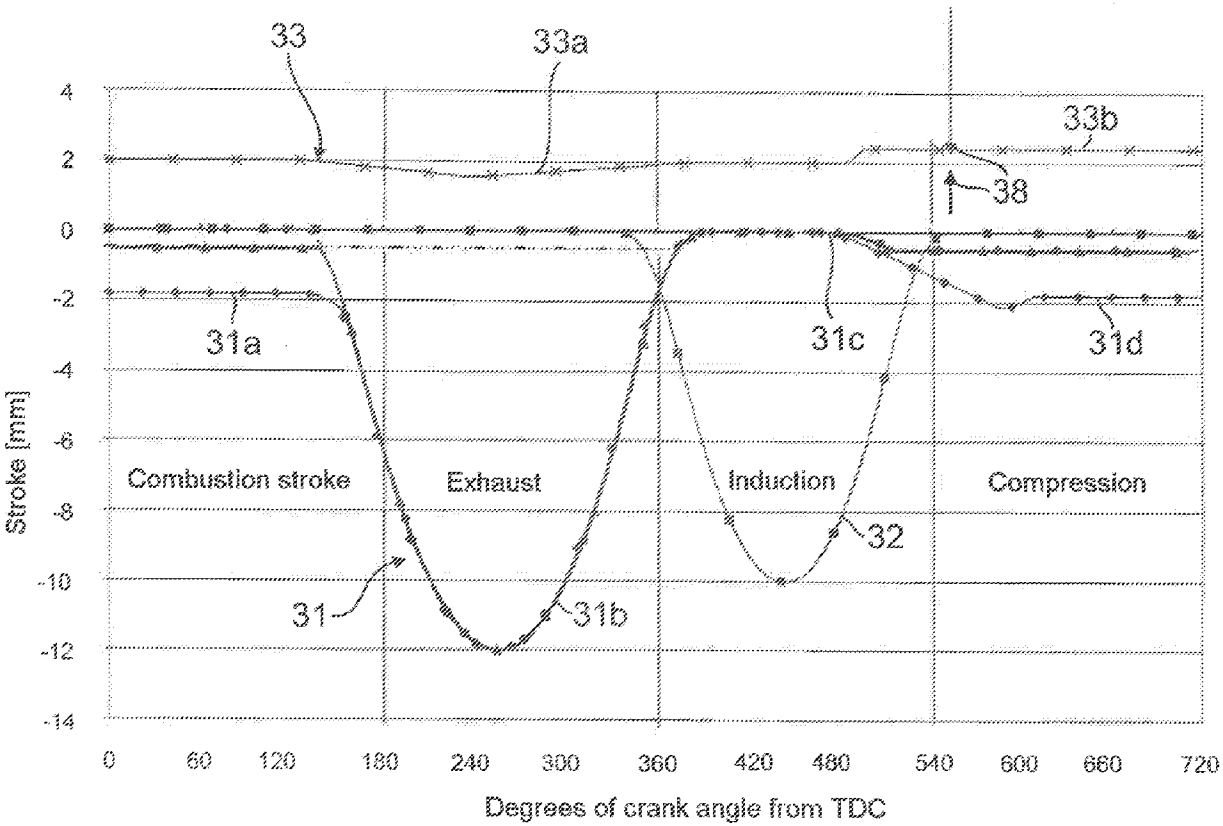
FIG. 3 shows a graph of the valve opening curves of the outlet valves and the inlet valves of the internal combustion engine over 720 degrees crank angle of the crankshaft of the internal combustion engine in the braking mode or EVB function with an illustration, inter alia, of the compensation function of the HVC without the use of said means in FIG. 2.
Figure 4:
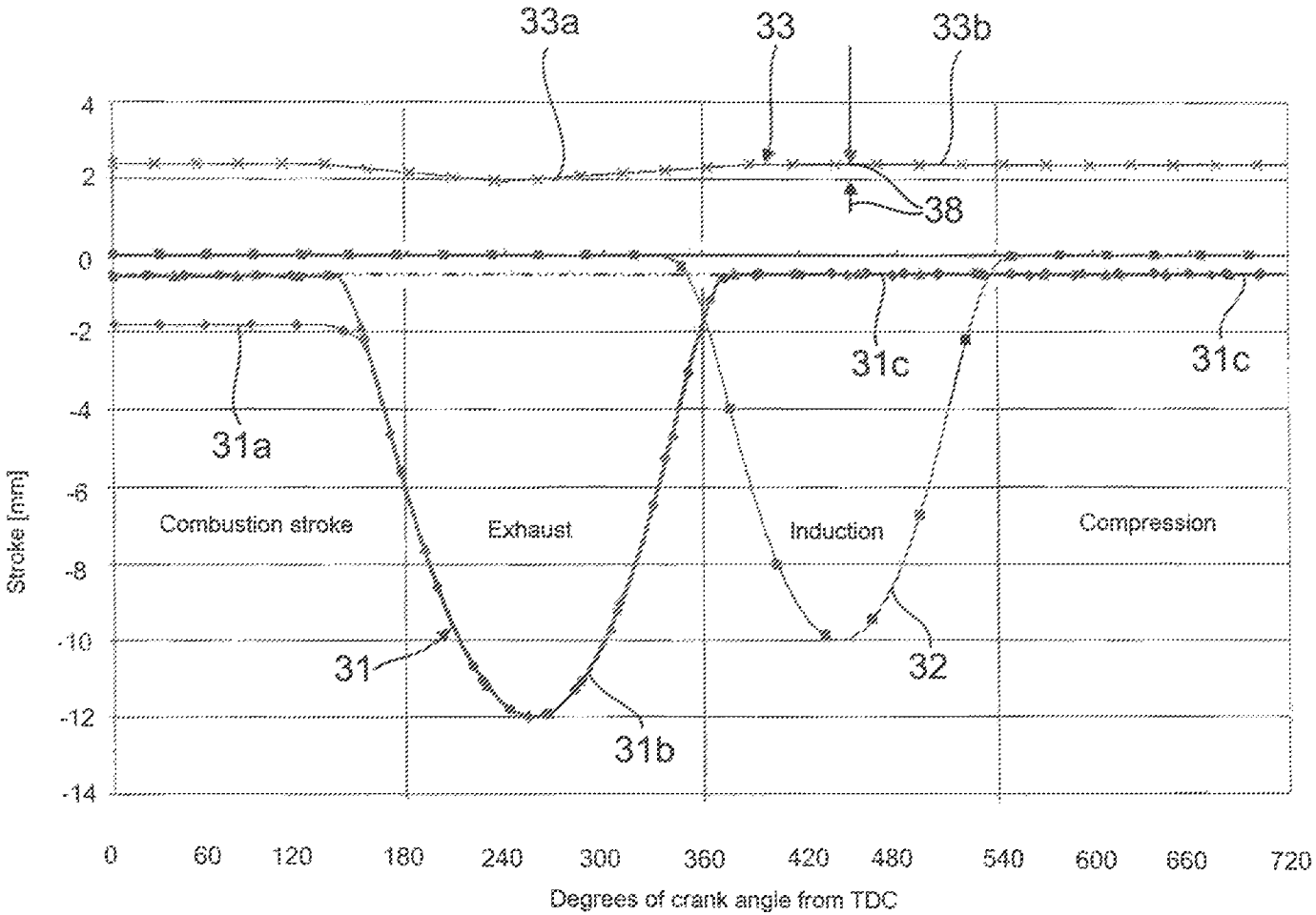
FIG. 4 shows the same graph during the transition from the braking mode or EVB mode into the fired.
Figure 5:
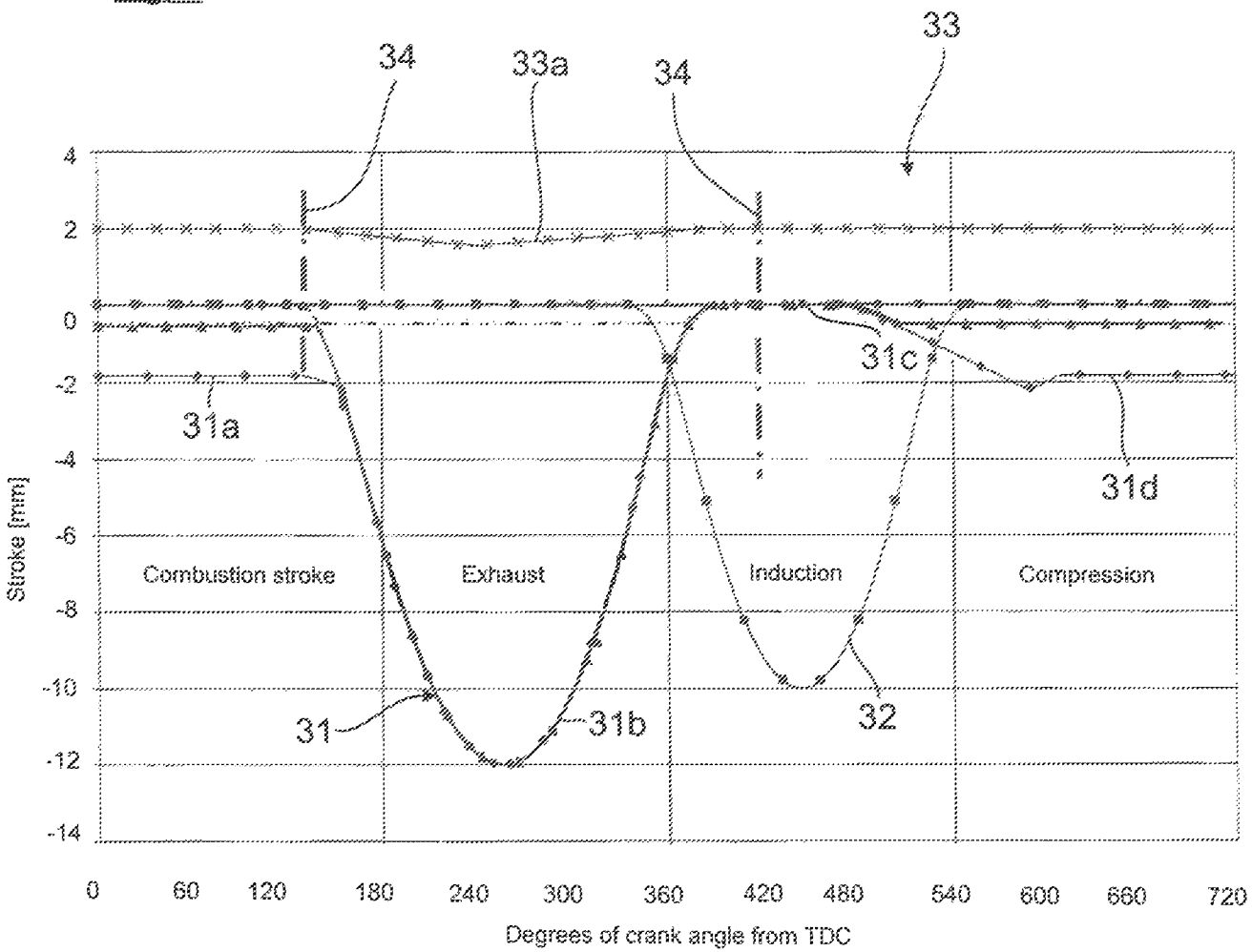
FIG. 5 shows a graph according to FIGS. 3 and 4 with the EVB mode of the internal combustion engine and an illustration of the modified compensation function of the HVC by way of the means which exerts an oppositely directed force.

The graphs according to FIGS. 3 to 5 show the function of the means 28 and/or 28*a* and/or 29 and/or 30 which counteract the adjusting action of the HVC 11 with a lower force, which graphs illustrate the valve stroke and the opening curves 31, 32 of the outlet valve 2 and an inlet valve over 720 degrees crank angle (CA) of the crankshaft of the internal combustion engine. Here, the graph according to FIGS. 3 and 4 corresponds to the function without the use of the means 28, 29 and/or 30 which exert an oppositely directed force, whereas the graph in FIG. 5 describes this with the means 28, 29 and/or 30.

FIG. 3 first of all shows the operating state of the internal combustion engine with engine braking or EVB function. Starting from a zero line which corresponds to closed inlet valves and outlet valves 2, 3, the outlet valve 2 (curve 31) is open in the intermediate position (curve section 31*a*). During passing of the cam section of the cam 4, the outlet valves 2, 3 are opened at approximately 180 degrees CA and are closed again at approximately 330 degrees CA, as shown in the curve section 31*b*. On account of the prevailing exhaust-gas backpressure and after the filling of the pressure space 16 in the piston/cylinder unit 15 (curve section 31*c*), the outlet valve 2 is opened again into the intermediate position (curve section 31*d*) for compression braking.

The relatively linear curve 33 which is illustrated above this describes the measured position of the tappet 24 of the HVC 11 during this operating cycle and without the means 28, 29 or 30 which exert an oppositely directed force.

The curve 33 shows minimum lowering 33*a* of the tappet 24 under the load of the valve opening at 31*b* and, in particular, an adjustment (arrows 38) of the tappet 24 after the closure of the outlet valves 2, 3 in the region 33*b*. This adjustment results from the indifferent movement sequences during the opening of the outlet valve 2, controlled via the exhaust-gas backpressure, and can disrupt reliable functioning of the EVB.

FIG. 4 shows the operating state of the internal combustion engine in the transition from the braking mode into the fired mode, the outlet valve 2 still being open in the intermediate position in the region 31*a* (combustion stroke). After passing the cam region of the cam 4 with corresponding opening of the outlet valves 2, 3 (curve section 31*b*), both outlet valves 2, 3 close again regularly at zero (curve section 31*c*) on account of the absence of the exhaust-gas backpressure with the exhaust-gas flap now open in the exhaust-gas section of the internal combustion engine. The inlet valves with the opening curve 32 open and close in the region between 330 degrees CA and 540 degrees CA in the usual way.

The curve 33, lying above this, of the tappet 24 of the HVC in turn shows the lowering at 33*a* and the required adjustment at curve section 33*b* which lies above the curve section 31*c*.

The graph according to FIG. 5 shows the described valve train with the means 28, 29 or 30 which counteract the adjusting action of the HVC 11 with a lower force in the engine braking mode. Here, the lines 34 limit the region from approximately 120 degrees CA to 420 degrees CA, in which region these means 28, 29, 30 do not act on account of the substantially higher actuating forces of the cam drive (outside the cam base circle).

The relevant difference to the above-described graphs consists in the fact that, in the dynamic movement sequences over the work cycle of the internal combustion engine and, in particular, during the transition from the closed position of the outlet valve 2 into its intermediate position, no disruptive valve play occurs any more in the valve train and accordingly, according to curve 33, no adjusting movement (arrows 38 of FIGS. 3 and 4 and section 33*b*) takes place. As a result, the engine braking function EVB is stabilized reliably as long as the exhaust-gas backpressure prevails.

Figure 7:
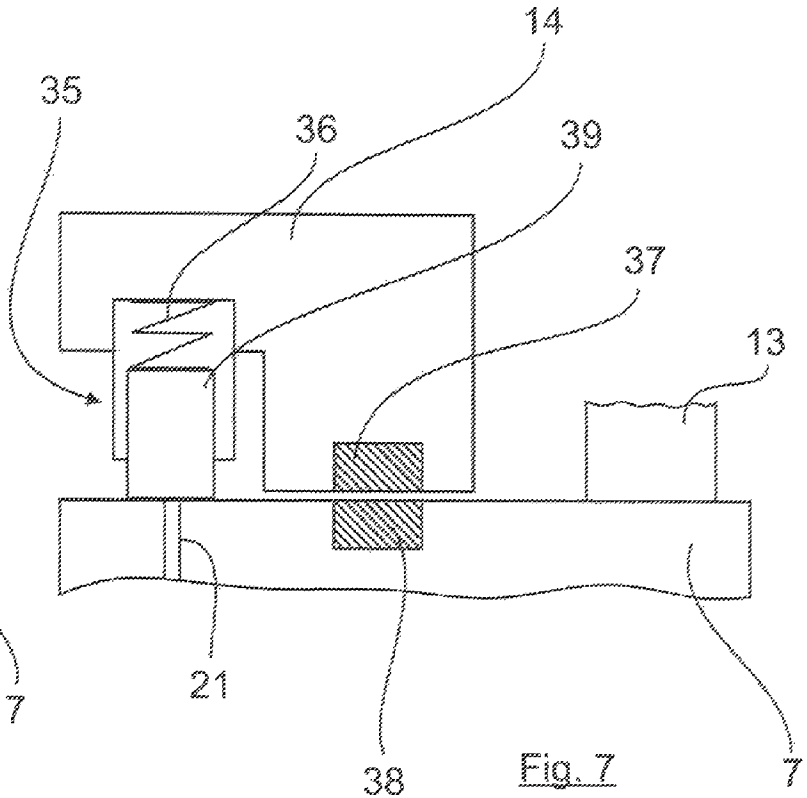
FIG. 7 shows the arrangement according to FIG. 6 in a second service life phase of the internal combustion engine.
Figure 6:
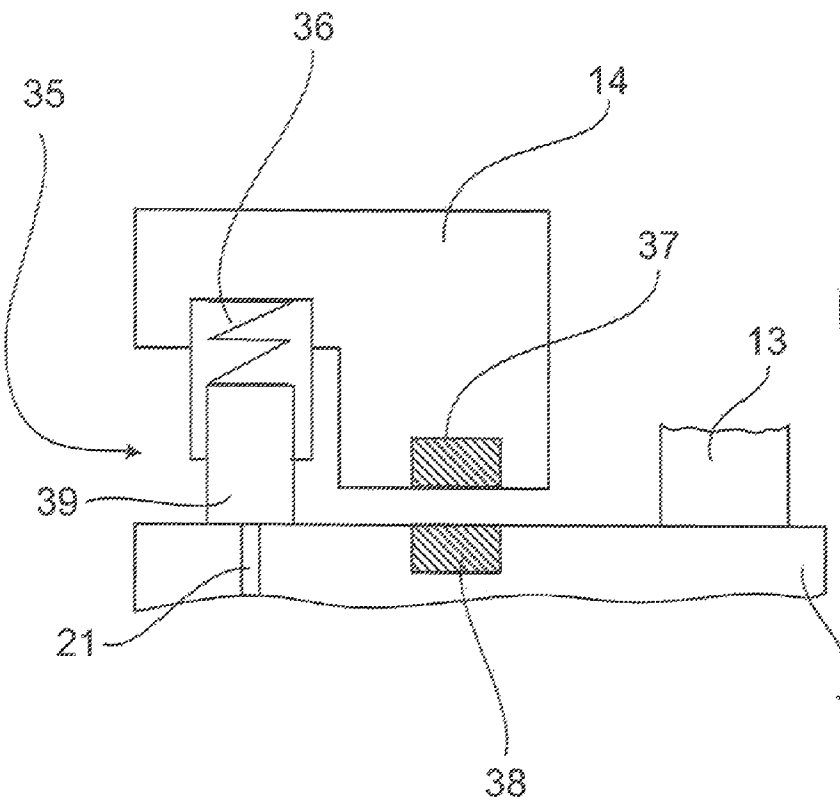
FIG. 6 shows an arrangement of a third piston/cylinder unit in a brace in a first service life phase of an internal combustion engine.

FIGS. 6 and 7 show the arrangement of a third piston/cylinder unit 35 in the brace 14, both figures diagrammatically showing the position of the valve crosshead 7 relative to the brace 14 in two different wear phases/service life phases of an internal combustion engine. During the service life cycle of the valve train, changes in play and/or changes in spacing of adjacent components of the valve train can occur. A defined play or a virtually play-free spacing between individual components of the valve train are to be ensured by the HVC 11 at least in the operating state of the internal combustion engine (at least after the operational oil pressure has been built up). Furthermore, however, the functionally reliable closing of the discharge channel 21 by the brace 14 during the passing of the base circle of the cam 4 is also essential. Since the HVC 11 brings about an adjustment in order to compensate for wear, the position of the valve crosshead 7 can change during passing of the cam base circle, which is shown diagrammatically in FIGS. 6 and 7 by the different vertical position of the valve crosshead 7 with regard to the brace 14. However, the abovementioned closure of the discharge channel 21 also has to be ensured in this case. This is achieved in the embodiment according to FIGS. 6 and 7 by the third piston/cylinder unit 35. By means of a prestressing means which is arranged in the brace 14 (for example, as shown, a spring 36, as an alternative or in combination the prestressing element can also be configured as an elastomer or by means of magnets which repel one another) which prestresses a piston 39 in the direction of the closure position of the discharge channel 21 in the valve crosshead 7, reliable closure or shut-off of the discharge channel 21 is always achieved despite the changed position of the valve crosshead 7. Both the HVC 11 and the third piston/cylinder unit 35 have to provide extension and retraction reserves in the factory state, that is to say in the state of a new, unused engine. Every possible change in the valve-train mechanism is therefore taken into consideration.

In addition, a permanent magnet 37, 38 can be arranged in each case in the brace 14 and the valve crosshead 7. These two permanent magnets 37, 38 attract one another, as a result of which a force which counteracts the adjusting action of the HVC 11 is exerted via the valve crosshead 7 and the connecting cup 13.

As an alternative or in addition to the embodiment which is shown, the third piston/cylinder unit 35 can also be arranged in the valve crosshead 7.

Furthermore, it can be seen from FIGS. 6 and 7 that the magnets can preferably be arranged in a separate component region, next to, for example, further elements, such as the third piston/cylinder unit 35 which is shown.

The invention is not restricted to the exemplary embodiments which have been described. Thus, instead of the two-part rocker arm 6, a single-part rocker arm or swinging arm with or without roller contact with the cam 4 can also be provided, for example.

The means for exerting a force which is directed counter to the adjusting action of the HVC can also be configured in a different way to that shown, but with the same function.

LIST OF DESIGNATIONS

1 Cylinder head
2 Outlet valve
3 Outlet valve
4 Cam
5 Rocker-arm axis
6 Rocker arm
**6*a*** Cam lever
**6*b*** Actuating lever
7 Valve crosshead
8 Pivot axis
9 Axis
10 Roller
11 Hydraulic valve-play compensation element (HVC)
12 Setting screw

13 Connecting cup
14 Brace
15 Piston/cylinder unit
16 Pressure space
17 Piston
18 Feed channel
19 Ball check valve
20 Feed channels
20*a* Ventilating bore
21 Discharge channel
22 Pressure space
23 Piston
24 Tappet
25 Piston
26 Pressure space
27 Non-return valve
28 Permanent magnet
28*a* Permanent magnet
29 Leg spring
29*a* Spring arms
29*b* Spring ends
30 Pull band
31 Opening curve, outlet valve
32 Opening curve, inlet valve
33 Adjustment curve, HVC
34 Demarcation lines
35 Piston/cylinder unit
36 Spring
37 Permanent magnet
38 Permanent magnet
39 Piston

What is claimed is:

1. An apparatus for actuating at least one outlet valve of a valve-controlled internal combustion engine for a motor vehicle, comprising:

an actuating element driven by a camshaft of the internal combustion engine;

a first piston/cylinder unit arranged on the actuating element between a cam of the camshaft and the at least one outlet valve, where the first piston/cylinder unit is configured to hold the at least one outlet valve in a non-closed intermediate position during an engine braking mode with exhaust-gas backpressure;

a second piston/cylinder unit arranged between the cam and the at least one outlet valve and configured as a valve play compensation element; and at least one valve train-side device exerting a force counter to and lower than an adjusting action of the valve play compensation element.

2. The apparatus according to claim 1, wherein the at least one valve train-side device comprises at least one magnet generating the force that exerts an attractive force on an adjacent component or on another magnet which is arranged in an adjacent component.

3. The apparatus according to claim 2, wherein the at least one magnet is a permanent magnet or an electromagnet which can be activated temporarily depending on at least one of defined and predetermined internal combustion engine parameters.

4. The apparatus according to claim 1, wherein the at least one valve train-side device includes at least one spring element generating the force.

5. The apparatus according to claim 1, wherein the at least one valve train-side device includes at least one elastomeric element generating the force.

6. The apparatus according to claim 1, further comprising at least one of a sacrificial magnet and a container-like collecting and receiving device is provided in a defined close range with respect to at least one valve train-side device.

7. The apparatus according to claim 1, wherein the at least one valve train-side device is arranged on one of the actuating element, a valve crosshead between the actuating element and the outlet valves, a connecting cup between the actuating element and the valve crosshead, a stationary brace of the valve train assigned to the valve crosshead.

8. The apparatus according to claim 7, wherein the actuating element is a two-arm rocker arm having an actuating lever which acts on the outlet valve and a cam lever which interacts with the cam, the first piston/cylinder unit being arranged on the actuating lever and the valve play compensation element is arranged on the cam lever.

9. The apparatus according to claim 8, wherein the at least one valve train-side device is arranged on one of the valve crosshead and the actuating lever and acts between the valve crosshead and the actuating lever.

10. The apparatus according to claim 7, wherein the actuating element is of two-piece configuration, having a cam lever and an actuating lever, the valve play compensation element being connected, with the at least one valve train-side device which exerts an oppositely directed force, between the cam lever and the actuating lever.

11. The apparatus according to claim 10, wherein the at least one valve train-side device is arranged on one of the valve crosshead and the actuating lever and acts between the valve crosshead and the actuating lever.

12. The apparatus according to claim 7, wherein the at least one valve train-side device is inserted on one of the valve crosshead and the stationary brace and acts between the valve crosshead and the brace.

13. The apparatus according to claim 1, wherein two outlet valves are provided in the valve train per cylinder of the internal combustion engine, the two outlet valves are actuated jointly by the actuating element by a valve crosshead, the first piston/cylinder unit being arranged in the valve crosshead and acting on only one of the two outlet valves.

14. The apparatus according to claim 1, further comprising a non-return valve being arranged in a feed line to the first piston/cylinder unit, the first piston/cylinder unit and the at least one valve train-side device being supplied with compressed oil jointly by a pressure-circulating lubricating-oil system of the internal combustion engine through the feed line, a pressure space of the first piston/cylinder unit having a discharge line controlled by a stationary brace in the closed state of the at least one outlet valve, and the first piston cylinder unit and a valve spring of the outlet valve are coordinated in such a way that the outlet valve remains open in a defined manner in the engine braking mode with a correspondingly closed exhaust-gas flap in the exhaust-gas system of the internal combustion engine.

15. The apparatus according to claim 1, further comprising at least a valve crosshead arranged between the actuating element and one of the outlet valve and a brace which is assigned to the valve crosshead, wherein the valve crosshead comprises a further piston/cylinder unit, by means of which a contact connection can be at least one of set and produced between the brace and the valve crosshead as a consequence of positional change of the valve crosshead relative to the brace.

16. The apparatus according to claim 15, wherein the contact connection can be produced between the brace and the valve crosshead for closing a valve crosshead-side discharge line by the brace.

17. A method for actuating, at least one outlet valve of a valve-controlled internal combustion engine using an apparatus, wherein the apparatus comprises an actuating element driven by a camshaft of the internal combustion engine, a first piston/cylinder unit arranged on the actuating element between a cam of the camshaft and the at least one outlet valve, a second piston/cylinder unit arranged between the cam and the at least one outlet valve and configured as a valve play compensation element, and at least one valve train-side device, the method comprising:

holding by the first piston/cylinder unit the at least one outlet valve in a non-closed intermediate position during an engine braking mode with exhaust-gas backpressure, and exerting by the at least one valve train-side device, a force counter to and lower than an adjusting action of the valve play compensation element.

18. A vehicle, comprising an internal combustion engine with the apparatus according to claim 1.

* * * * *